US009854879B2

(12) United States Patent
Barr

(10) Patent No.: US 9,854,879 B2
(45) Date of Patent: Jan. 2, 2018

(54) FLAT KEY RING

(71) Applicant: Caffeinate Labs, Inc., Portland, MA (US)

(72) Inventor: Nathan Gregg Barr, Portland, MA (US)

(73) Assignee: Caffeinate Labs, Inc., Portland, ME (US)

( * ) Notice: Subject to any disclaimer, the term of this patent is extended or adjusted under 35 U.S.C. 154(b) by 0 days.

(21) Appl. No.: 15/152,561

(22) Filed: May 12, 2016

(65) Prior Publication Data

US 2017/0325550 A1 Nov. 16, 2017

(51) Int. Cl.
*A44B 15/00* (2006.01)
*E05B 19/00* (2006.01)

(52) U.S. Cl.
CPC ..... *A44B 15/002* (2013.01); *A44B 15/00* (2013.01); *E05B 19/00* (2013.01)

(58) Field of Classification Search
CPC ..... E05B 19/00; E05B 19/04; A44B 15/00; A44B 15/02; A44B 15/002
See application file for complete search history.

(56) References Cited

U.S. PATENT DOCUMENTS 603,247 A 5/1898 Becker
803,839 A 11/1905 Merrill
812,458 A * 2/1906 See ..... A44B 15/00 70/458
1,286,501 A * 12/1918 Bauer ..... F16G 15/02 70/458
1,391,364 A * 9/1921 Bulow ..... A44B 15/00 403/340
1,462,205 A 7/1923 Korns
1,526,498 A * 2/1925 James ..... A44B 15/00 70/458
1,568,364 A 10/1925 Iverson
2,432,870 A * 12/1947 Evalt ..... B29C 53/12 70/458
2,877,640 A * 3/1959 Anderson ..... A44B 15/00 70/459
4,478,381 A 10/1984 Piton et al.
4,533,149 A 8/1985 Vater et al.
4,844,487 A 7/1989 Eakin
4,958,791 A 9/1990 Nakamura
5,513,857 A 5/1996 Watanabe et al.
(Continued)

*Primary Examiner* — Christopher J Boswell
(74) *Attorney, Agent, or Firm* — McInnes & McLane, LLP

(57) ABSTRACT

This invention is directed toward a flat, washer-like key ring. In some embodiments, the key ring is substantially circular. It is distinct from prior art in that the key ring largely, or entirely, resides in a single plane, as opposed to being concentric circles overlapped one on top of the other. The key ring has a split line running through a portion of its body. The split line creates inner and outer segments along a portion of the plane of the body. The split line can be non-linear, in that it may not be a straight line. As such, the split line has protrusions and slots running along its length. These protrusions and slots interact mechanically to allow the key ring to remain securely closed, and endure greater radial forces, by coupling the inner and outer segments together. The inner and outer segments are also releasably attached so as to facilitate the addition or removal of a key.

23 Claims, 9 Drawing Sheets

(56) References Cited

U.S. PATENT DOCUMENTS

| | | | | |
|---|---|---|---|---|
| 5,996,191 | A * | 12/1999 | Christler | A44B 15/00 70/458 |
| 6,164,605 | A | 12/2000 | Drake et al. | |
| 6,488,461 | B1 | 12/2002 | Zacharias et al. | |
| 6,681,608 | B1 | 1/2004 | Hope, III | |
| 6,845,644 | B1 | 1/2005 | Buckner | |
| 6,860,130 | B2 | 3/2005 | Brantschem | |
| 7,011,482 | B2 | 3/2006 | Underwood et al. | |
| 7,093,468 | B2 | 8/2006 | Song | |
| 7,165,772 | B1 | 1/2007 | Camacho | |
| D666,407 | S | 9/2012 | Schoultz | |
| 2004/0068846 | A1 | 4/2004 | Karlinger | |
| 2004/0079126 | A1 | 4/2004 | Ullman | |
| 2006/0225257 | A1 | 10/2006 | Michelon | |
| 2008/0087063 | A1 | 4/2008 | Tzu-Shun | |
| 2009/0235705 | A1 | 9/2009 | Knapton | |
| 2010/0038506 | A1 | 2/2010 | King et al. | |
| 2013/0008214 | A1 | 1/2013 | von Shoultz | |

* cited by examiner

FLAT KEY RING

FIELD

The present invention relates generally to a substantially flat key ring.

BACKGROUND

For centuries individuals have used key rings to hold, organize, and easily transport the keys they use on a regular basis. Some examples of this type of key ring are disclosed in the following United States Patents, the entire contents of which are all hereby incorporated by reference: U.S. Pat. No. 603,247 entitled "Key-Holder" ("247 patent"), U.S. Pat. No. 1,462,205 entitled "Key Ring and the Like," and Pat. No. D666,407 entitled "Key Ring." These style key rings have the advantages of being durable and compact. The disadvantage, however, of these type of key rings is—it is often very difficult to separate the rings in order to add or remove keys.

Indeed, the '247 patent sought to overcome the difficulty of adding or removing keys. According to the inventor, his "invention relates more particularly to key-holders commonly known as 'split-rings,' but is also applicable to other forms of key holders composed of a single piece of wire or strip of metal in which a separation of overlapping portions of the wire or metal is requisite for the insertion or removal of a key. Split rings as commonly constructed have their free ends flush with the body of the ring, and when composed of specifically stiff or heavy metal it is extremely difficult to expand them sufficiently for the insertion or removal of a key without other aid than the fingers and the use of a knife-blade or other suitable article for this purpose . . . " '247 patent at 8-22. The '247 patent went on to solve this problem by disclosing a key holder that would "admit of a ready separation of the parts without other aid than the key itself when being applied to the holder and which may be readily separated by hand in removing a key therefrom;" '247 patent at 34-38. Although the '247 patent issued in 1898, still, over a century later, modern day key rings are very difficult to separate in such a way so as to be able to add or remove a key.

FIG. 1 is a perspective view of a typical prior art key ring 100. As can be seen in FIG. 1, prior art key rings 100 typically consist of two concentric approximate circles 110, 120 proximal to one another. The lower approximate circle 110 and the upper approximate circle 120 are made of a single wire 102, which has been bent to form the two concentric approximate circles 110 and 120. One of the reasons that the two concentric approximate circles 110 and 120 are referred to as "approximate circles" and not just "circles" is because, as can be seen in FIG. 1, starting neither of the approximate circles 110, 120 is a comprised of a full 360-degrees of metal, or alternative material, within a single plane. This design feature allows a user to longitudinally displace an end, e.g., 112 of an approximate circle 110 in order to add or remove a key.

Keeping keys securely in place is an obvious goal of any key ring. In order to keep keys in place, key rings must be able to withstand radial and orthogonal, out of plane forces that will be placed upon the key ring during ordinary use. Referring to FIG. 1, latitudinal forces would occur both as latitudinal forces along the x-axis 160 and longitudinal forces along the y-axis 165. Prior art key rings 100 are able to withstand substantial radial forces without compromising the integrity of the key ring's 100 ability to keep the keys secure. This is a function of the fact that prior art key rings 100 are typically comprised of two concentric approximate circles of wire 110, 120 having a fairly large relative wire gauge diameter to the wind diameter of the concentric circles.

In terms of orthogonal force, it is desirable for the key ring to require sufficient orthogonal such that keys do not easily fall off of the key ring unintentionally. The orthogonal force should not, on the other hand, be so great that it is difficult to add or remove keys. The orthogonal force required to displace an end 112 of an approximate circle 110 sufficiently to facilitate the addition or removal of a key depends upon the ratio of the area moment of inertia (of the key ring cross section) to the diameter of the key ring. The area moment of inertia is proportional to the thickness of the key ring and the band width, defined as the difference between the outer and inner radii. Most key rings are designed with a sufficiently large wire gauge diameter so as to resist radial forces exerted on the key ring. However, the round nature of the wire used creates an equally resilient geometry resisting orthogonal forces. This results in a burdensome task for the user to overcome the orthogonal force required to add or remove keys.

Because of this difficulty, there are numerous patents directed toward devices that assist individuals in separating the concentric rings of a typical key ring in order to add or remove keys. As examples, the following U.S. patents and patent applications, each of the contents of which are hereby incorporated by reference, are directed towards devices that assist a user in adding or removing a key from a traditional key ring: US2009/0235705 entitled "Key Ring Tool," U.S. Pat. No. 6,681,608 entitled "Key Ring Opener Assembly," and U.S. Pat. No. 6,860,130 entitled "Easy-to-Maneuver Key-Ring." While these tools can overcome the difficulty of adding or removing keys from modern day key rings, they do not overcome the original problem presented in the '247 patent, i.e., adding or removing keys from a key rings was difficult to do in the late 1800's without the assistance of extra tools; and adding or removing a key from a key ring is still difficult to do over a century later without using a separate tool.

Some inventors have addressed this long-standing problem by altering the basic shape of the key ring. By way of example, all of the contents of which are hereby incorporated by reference, U.S. Pat. No. 803,839 entitled "Key-Ring," disclosed carabiner-style triangular and square key rings, while U.S. Patent Application No. 2008/0087063, entitled "Key Ring Assembly," was directed toward a key ring having a light bulb shape. While these types of key rings are easier to open than the traditional key rings described above, they are bulkier to carry, and therefore less desirable to a substantial number of consumers.

There is, therefore, a need in the art for a round key ring that is capable of securely holding one's keys, while simultaneously providing an easy means for adding and removing keys without the need to rely on a separate tool or to risk bending one's fingernails, which is painful and annoying.

SUMMARY OF THE INVENTION

The invention disclosed herein overcomes some of the shortcomings of the prior art by disclosing a flat, washer-like key ring which in one embodiment is cut in two dimensions from a sheet of metal to form a specific geometry that is strong in the direction of radial forces but easy to bend the ends of the ring apart in the longitudinal direction. The ends of the key ring are further specifically designed to easily allow a user's fingers to manipulate while at the same time not allowing keys to risk accidentally falling from the ring.

DETAILED DESCRIPTION

Those of skill in the art will recognize throughout this specification that when like terms are used to describe features and functionalities of various portions of a particular embodiment, those same features and functionalities could be present in additional embodiments having aspects with like terms.

Figure 1:
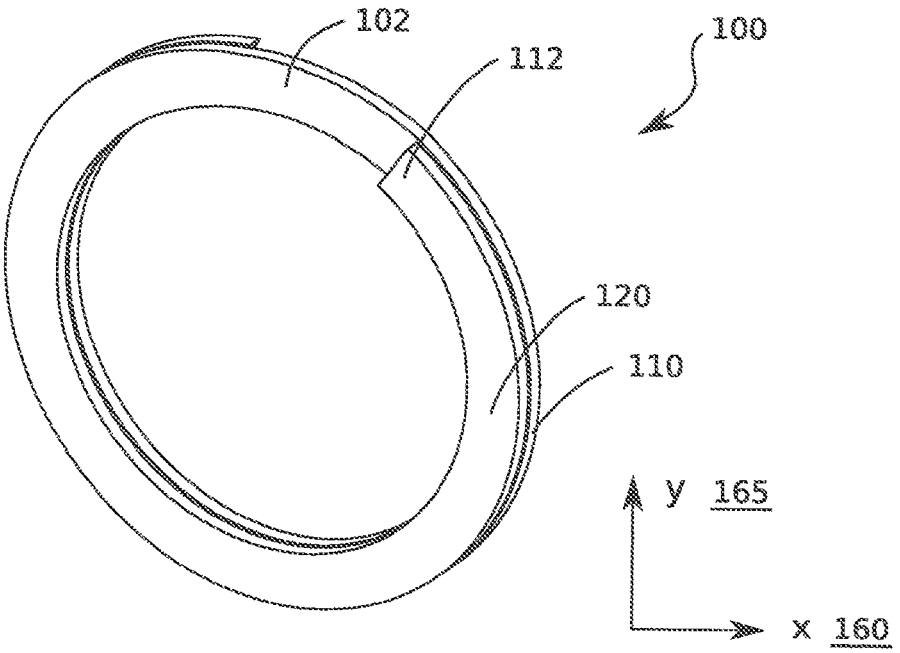
FIG. 1 (PRIOR ART)
FIG. 1 is a perspective view of a prior art key ring.
Figure 2A:
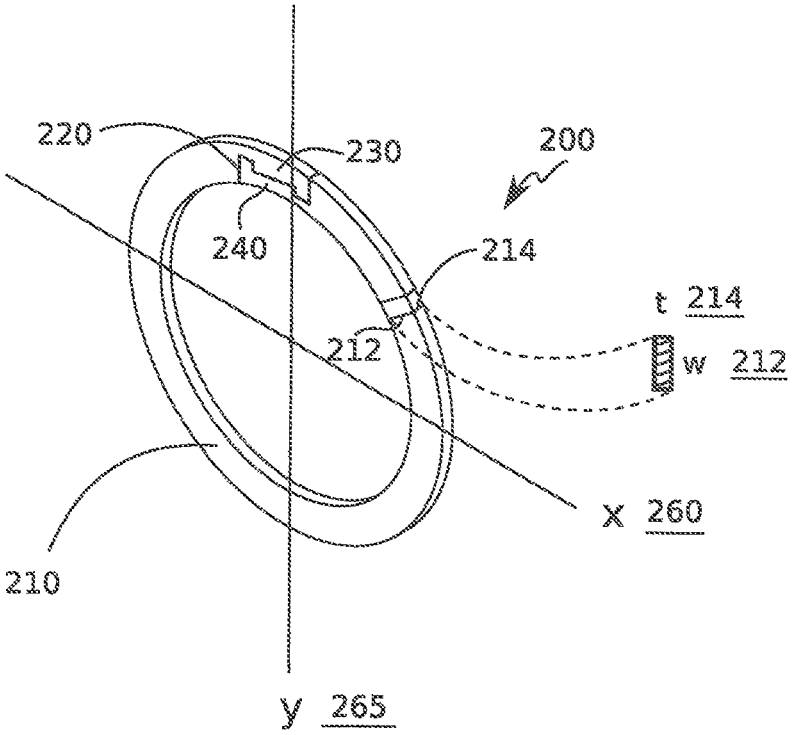
FIG. 2A is a perspective view of a flat, washer-like key ring of embodiments disclosed herein.

FIG. 2A shows an embodiment of the inventive key ring 200. The key ring 200 of this embodiment is comprised of a flat, planar, looped body 210 in some embodiments. One measure of the flatness of an object is its aspect ratio of a cross-sectional area taken as a function of width over thickness. In the embodiment of the key ring 200, the aspect ratio 210 of a cross sectional area, taken as a function of width 212 over thickness 214 could range from 2 to 6. In embodiments of the present invention, I disclose a planar key ring 200 as opposed to prior art key rings 100, which consisted of two concentric approximate circles 110, 120 proximal to one another. The planar key ring 200 occupies a single plane 210 in some embodiments, as opposed to having stacked geometric shapes as is evident in the prior art.

Figure 3A:
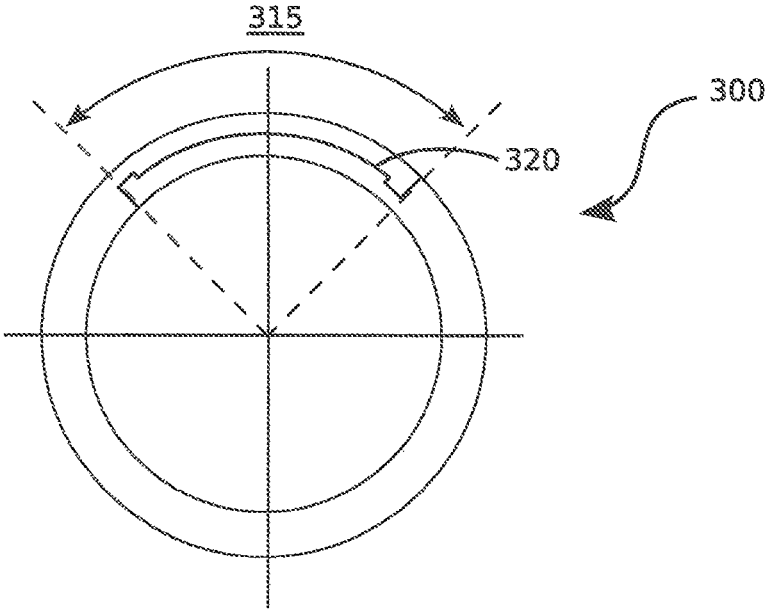
FIG. 3A is a plan view of flat, washer-like key ring of embodiments disclosed herein.
Figure 3B:
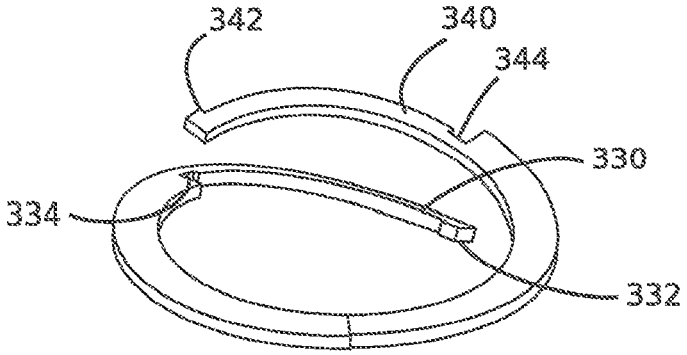
FIG. 3B is a perspective view of a flat, washer-like key ring of embodiments disclosed herein.

As can be seen in FIG. 2A, key ring 200 includes a split 220 within its planar structure 210. An alternate embodiment of key ring 300 is shown in FIG. 3A, which also includes a split 320. The split 320 is a cut through the body of the key ring 300. The split 320 could formed with a laser cutter, an electrical discharge machining (EDM), electro-chemical erosion, water jet cutting, or similar techniques known to those skilled in the art. When the split 320 is cut into the body of the key ring 300, the result is, a portion of the key ring 300 has been cut into an outer segment 330 and an inner segment 340, as can be seen in FIG. 3B.

The outer segment 330 and the inner segment 340 are complimentarily contoured so that they can couple together to form a secure hold. In some embodiments, the outer segment 330 or the inner segment 340 or both could further include a protrusion or a slot. In the embodiment shown in FIG. 3B, the outer segment 330 includes protrusion 332 and slot 334. Inner segment 340 includes protrusion 342 and slot 344. The protrusions 332, 342 are configured to fit securely within the slots 334, 344, thereby creating a complimentarily contoured surface that facilitates coupling between the outer segment 330 and the inner segment 340.

Figure 3C:
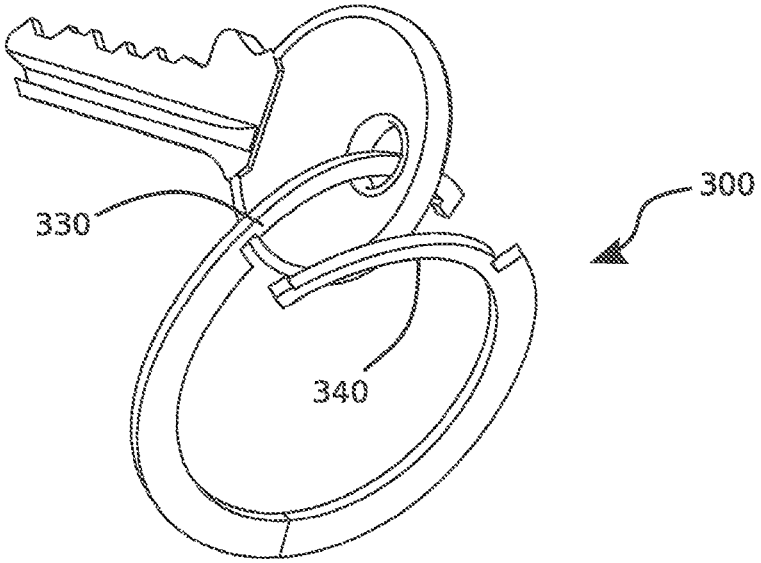
FIG. 3C is a perspective view of a flat, washer-like key ring of embodiments disclosed herein showing how a key can be added or removed from the key ring.
Figure 3D:
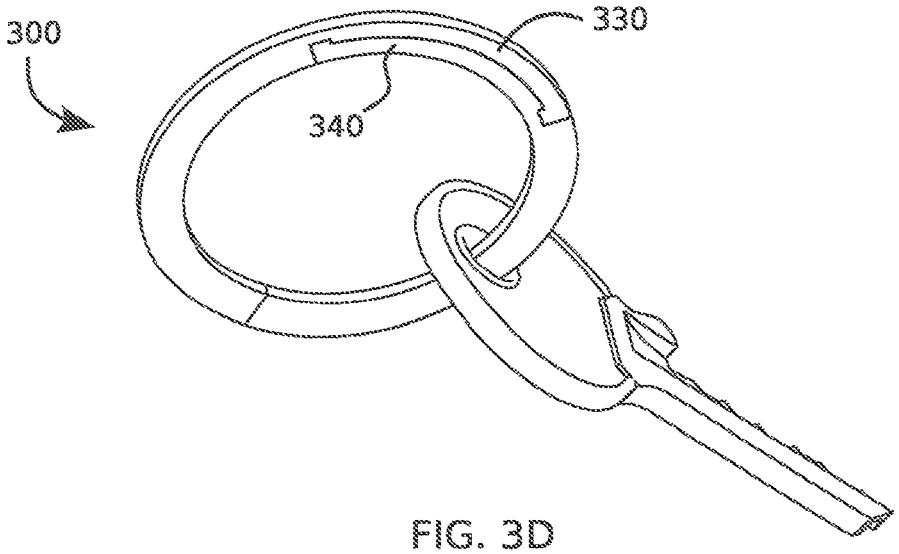
FIG. 3D is a perspective view of a flat, washer-like key ring of embodiments disclosed herein showing a key secured thereon.

FIG. 3C depicts the key ring 300 in a releasably detached position. When the key ring 300 is in the releasably detached position, it is well suited for adding or removing a key to the key ring 300. A key can be added or removed by separating the outer segment 330 from the inner segment 340 a sufficient distance to allow a key to pass therebetween. FIG. 3D depicts the outer segment 330 and the inner segment 340 being coupled together again after a key has been added to the key ring 300.

With reference to FIG. 2A, and as a practical matter, the key ring 200 must be designed so as to resist excessive strain due to the hoop stress of tensile radial forces exerted along both the latitudinal x-axis 260 and the longitudinal y-axis 265. As those of skill in the art will recognize, a radial force applied along the x-axis 260 will force the inner 240 and outer 230 segments of the key ring 200 to become detached from one another. This will result in the loss of keys, which is an undesirable result for the key ring 200. Similarly, a longitudinal force could have the same effect.

Figure 2B:
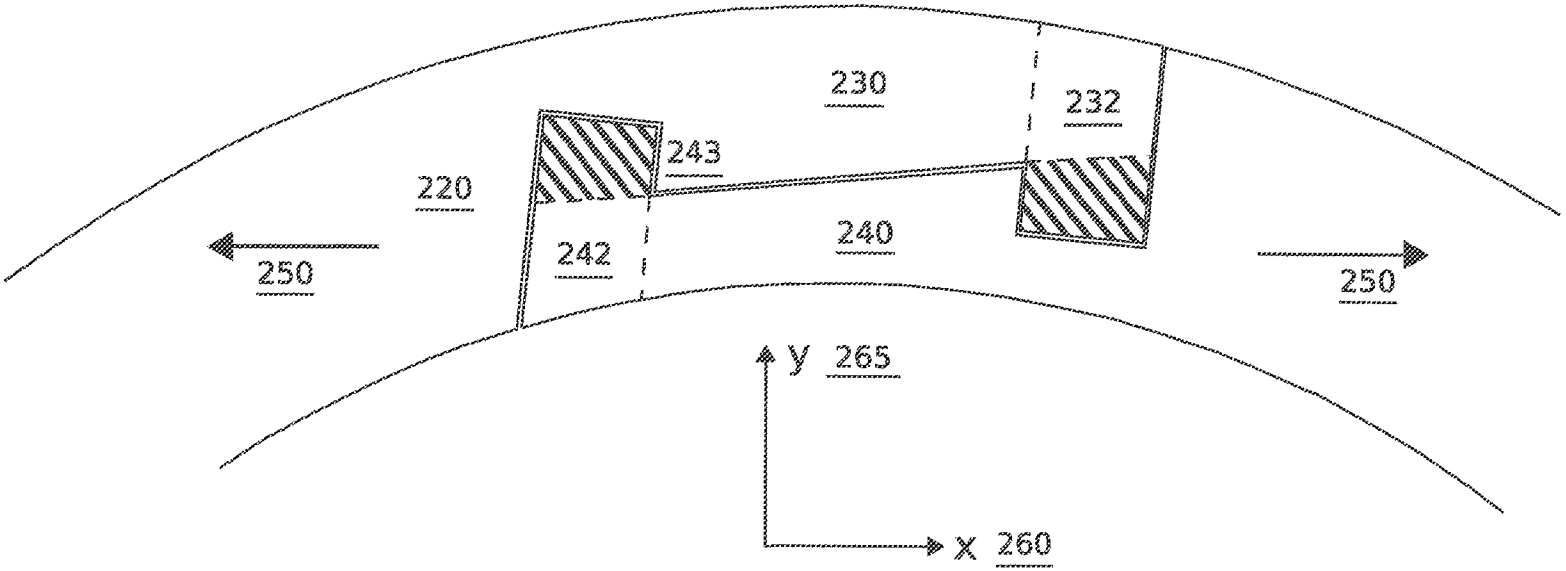
FIG. 2B is a plan view of a cross-section of a flat, washer-like key ring of embodiments disclosed herein.

In order to increase the key ring's 200 radial strength, embodiments herein have been designed so as to take advantage of the physics that follow from the geometry forming relative heights and angles of protrusions 332, 342 and slots 334, 344. FIG. 2B shows a plan view of a cross section of key ring 200. The cross section includes slit 220, which is the cut line though the body of the key ring 200 that creates an outer segment 230 and an inner segment 240. The outer segment 230 has protrusion 232, while the inner segment has protrusion 242. When the outer segment 230 is coupled to the inner segment 240, as shown in FIG. 2B, the protrusions 232, 242 fit securely within receiving slots in their complimentary contoured counterpart. This coupling is shown as diagonal lines within FIG. 2B.

If there is insufficient hoop-strength integrity in the design of the key ring 200, the outer segment 230 will separate from the inner segment 240 along the x-axis 260. This could result in a large enough gap between the outer segment 230 and the inner segment 240 that a key(s) could accidentally slip off of the key ring 200. It could also result in the hoop stress exceeding the elastic deformation limit and thus permanently deforming the key ring 200 which would be undesirable and potentially render it unusable. When latitudinal radial force 250 is applied to the key ring 200, an outer edge 243 of the protrusion 242 transfers approximately half of force 250 through the split side and half of force 250 through the proximal side. Thus, effectively reducing the hoop stress by 50% and resulting in a greater magnitude of force 250 that can be sustained by key ring 200. This transfer will occur so long as the relative angle between the x-axis 260 and the outer edge 243, using the axes depicted, ranges from about 60-degrees to about 90-degrees. The lower range is dependent on the coefficient of friction for the material and surface roughness of key ring 200. The upper range of the relative angle could be beyond 90 degrees, in essence forming a "hook", but without any significant functional advantage.

Longitudinal forces are accounted for by virtue of the coupling between the protrusions 332, 342 and slots 334, 344. The complimentary contouring of the inner 340 and outer 330 segments of the key ring 300 diminish longitudinal forces, using a similar behavior as previously described for the latitudinal forces, thereby keeping keys securely in place.

Figure 4:
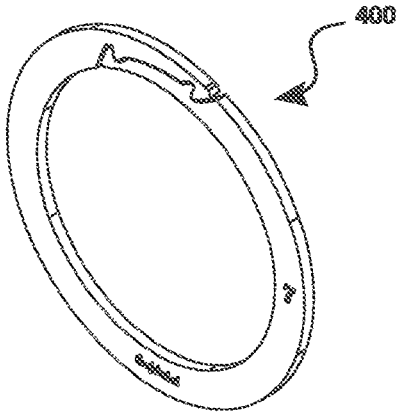
FIG. 4 is a perspective view of a flat, washer-like key ring of embodiments disclosed herein.
Figure 5:
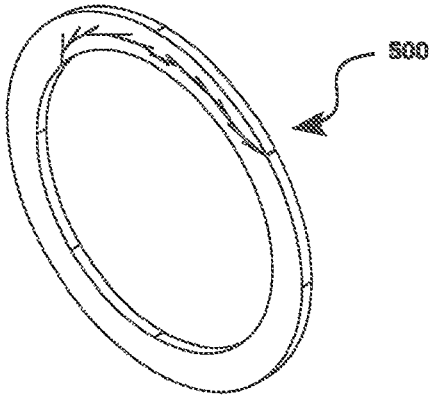
FIG. 5 is a perspective view of a flat, washer-like key ring of embodiments disclosed herein.
Figure 6:
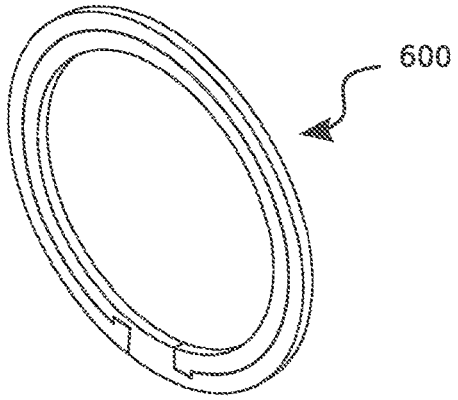
FIG. 6 is a perspective view of a flat, washer-like key ring of embodiments disclosed herein.

In embodiments, the arc angle of the split can vary within a range of between 5-degrees and 355-degrees. FIG. 3A depicts an arc angle 315 that is approximately 90-degrees. The size of the arc angle 315 depends upon the arc length of the split 320 line cut through the body of the key ring 300. FIGS. 4-6 depict alternate embodiments having varying arc angles and various arc length split lines.

Figure 7A:
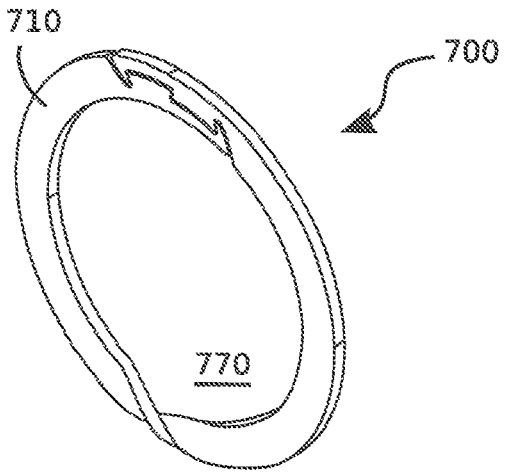
FIG. 7A is a perspective view of a flat, washer-like key ring of embodiments disclosed herein.
Figure 7B:
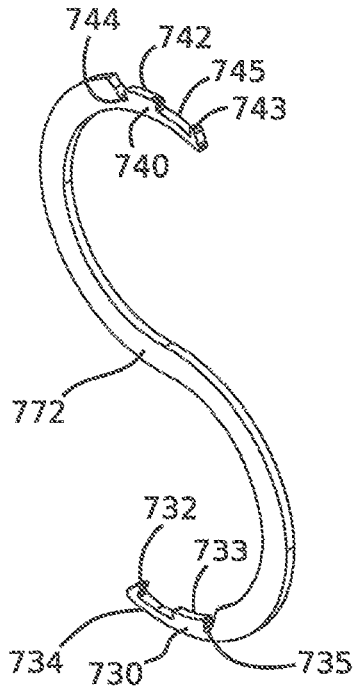
FIG. 7B is a perspective view of an S-shaped member used in some embodiments to create a key ring according to embodiments disclosed herein.

In terms of substantial circularity, key rings 200, 300, 400, 500, 600 are depicted as circular. Those of skill in the art will recognize that the key rings 200, 300, 400, 500, 600 could be substantially circular, oval, elliptical, square, rectangular, trapezoidal, or polygonal. FIG. 7A shows an alternative key ring 700 with a twisted portion 770 integral to the planar, looped body 710. FIG. 7B shows how this embodiment could be formed from an S-shaped member having an outer segment 730 with protrusions 732, 733 and slots 734, 735 and an inner segment 740 having protrusions 742, 743 and slots 744, 745. The S-shaped member could be formed into key ring 770 by heating and twisting the body so that it changes its shape to be looped, and in some embodiments, substantially circular as depicted in FIG. 7A. In alternate embodiments, the shape could of key ring 700 could be oval, elliptical, square, rectangular, trapezoidal, or polygonal. In yet alternate embodiments, the key ring 700 could be formed by stamping; pressing the S-shaped member could create the twist 770 in the body of the key ring 700.

In certain embodiments, the flat, planar looped key ring embodiments could range in outer diameter from approximately 0.25 inches to 2.5 inches. Additionally, key ring embodiments could range in band width, defined as the difference between the outer and inner radii, from approximately 0.05 inches to 0.25 inches. The inner diameter is perhaps best expressed as a percentage of the outer diameter, and in such case could range from approximately 50% to 95%. Additionally, key ring embodiments could range in thickness from approximately 0.01 inches to 0.25 inches. The thickness is perhaps best expressed as a percentage of the key ring band width, determined as the difference in the outer and the inner radii, and in such case could range from 20% to 100%. The preferred embodiment has an outer diameter of between approximately 1.25 inches and 1.5 inches. Additionally, the preferred embodiment has an inner diameter of approximately 80% of the outer diameter and a thickness roughly 30% of the band width.

In certain embodiments, the flat, planar, looped key ring embodiments could be made of metal (for example and without limitation, stainless steel, ferromagnetic steel, other purpose steels, gold, silver, copper, titanium, aluminum, tungsten, or zinc), wood, plastic, silicone, plastic, ceramic, carbon fiber, or rubber. Some of these materials could in additional embodiments be subjected to treatment, such as hardening to further strengthen the compact key ring body. For example, certain forms of both stainless and general purpose steel can be heat treated by heating the metal in a furnace to the critical temperature to change the molecular structure and then quenching to quickly cool the material and retain the modified molecular structure. In these embodiments, it is desirable to temper the metal at a lower temperature in a furnace shortly after quenching to restore a certain amount of toughness and reduce the brittleness of the material.

In alternate embodiments, the metal can be "cold" worked, such as cold rolling sheet metal, to impart internal stress into the bulk of the material, which acts similarly to heat treatment in modifying the physical properties of the material. Proper selection of material is important so that the key ring can be used for the intended functions without sustaining plastic deformation, as is the case when the applied stress exceeds the yield strength of the material. Hardening the metal, such as with the techniques described above, can help by increasing the yield strength of the material.

In one embodiment, the application of fine processes, such as laser cutting, allow for the present invention to achieve the desired balance between maximizing product strength and minimizing key ring split line thickness. In alternate embodiments, the cutting tool could be an electrical discharge machining (EDM), electro-chemical erosion, water jet cutting, or similar techniques known to those skilled in the art. In an alternate embodiment, the key ring could be created by using a blanking or even fine blanking stamping die to punch parts out of the sheet metal. In these embodiments, and others that are similar and known to those of skill in the art, the application of fine processes allows for precision edges, shapes, sizes, contours, and notches to be created thereby facilitating the operational and structural capabilities of the key ring features discussed herein.

Accordingly, in a method embodiment of the present invention, the method is comprised of forming a substantially flat, planar key ring comprising cutting or stamping a single planar member wherein the member looped and is shaped as substantially circular, oval, elliptical, square, rectangular, trapezoidal, S-shaped, or polygonal; and creating a split in the member wherein the split forms an outer segment and an inner segment within the planar body, the outer and inner segments further comprising complimentary contouring suited for coupling the outer segment to the inner segment and releasably detaching the outer segment from the inner segment.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. A flat, washer-like key ring comprising:

a. a planar, looped body having a rectangular cross-section;

b. a split within the planar, looped body wherein the split forms an outer segment and an inner segment within the planar, looped body; and c. the outer and inner segments further comprising complimentary contouring suited for coupling the outer segment to the inner segment and releasably detaching the outer segment from the inner segment.

2. The flat, washer-like key ring of claim 1 wherein the looped body is substantially circular, oval, elliptical, square, rectangular, trapezoidal, or polygonal.

3. The flat, washer-like key ring of claim 1 wherein the outer segment or the inner segment is further comprised of at least one protrusion and at least one slot.

4. The flat, washer-like key ring of claim 3 wherein the at least one protrusion has an outer edge having an angle relative to a radial line of greater than approximately 60 degrees.

5. The flat, washer-like key ring of claim 1 further comprising an aspect ratio of a cross-sectional area that is greater than 2.

6. The flat, washer-like key ring of claim 1 wherein the split has an arc angle ranging from 5 degrees to 355 degrees.

7. The flat, washer-like key ring of claim 1 wherein the planar, substantially circular body is made of metal, stainless steel, ferromagnetic steel, other purpose steel, aluminum, titanium, steel, brass, tungsten, zinc, cooper, silver, gold, platinum, ceramic, carbon fiber, silicone, plastic, fiberglass, wood, or rubber.

8. The flat, washer-like key ring of claim 1 wherein the planar, substantially circular body is stamped, fine blanked, laser-cut, electrically discharged machined, electro-chemically eroded, or water jet cut.

9. The flat, washer-like key ring of claim 1 wherein an outer diameter is between approximately 0.25 inches to 2.5 inches.

10. The flat, washer-like key ring of claim 1 wherein a difference between an outer radius and an inner radius is between 0.05 inches and 0.25 inches.

11. The flat, washer-like key ring of claim 1 wherein an inner diameter is approximately 50% to 90% of an outer diameter.

12. The flat, washer-like key ring of claim 1 wherein a thickness of the planar, looped body is between approximately 0.01 inches and 0.25 inches.

13. The flat, washer-like key ring of claim 1 wherein a thickness is between approximately 20% to 100% of a band width.

14. The flat, washer-like key ring of claim 1 wherein an outer diameter is between approximately 1.25 inches to 1.5 inches.

15. The flat, washer-like key ring of claim 14 further comprising a twist in the planar body.

16. The flat, washer-like key ring of claim 1 wherein an inner diameter is approximately 80% of an outer diameter; and a thickness of approximately 30% of a band width.

17. The flat, washer-like key ring of claim 1 further comprising a twist in the planar, looped circular body.

18. The flat washer-like key ring of claim 1 wherein the planar, looped body further comprises at least one slit through the planar, looped body.

19. The flat, washer-like key ring of claim 18 wherein the at least one slit is centered substantially opposite of a center point of the split.

20. The flat, washer-like key ring of claim 18 further comprising a second slit, the at least one slit and the second slit creating a grouping of more than one slit wherein the grouping of more than one slit is substantially centered relative to a center point of the split.

21. The flat, washer-like key ring of claim 18 wherein the combined arc angle of the one or more slits ranges from 15 degrees to 345 degrees.

22. The flat, washer-like key ring of claim 18 wherein the at least one slit serves the purpose of reducing the residual material strain.

23. The flat, washer-like key ring of claim 18 wherein the at least one slit serves the purpose of lowering the bend.

* * * * *